United States Patent [19]

Hesler et al.

[11] Patent Number: 5,026,456

[45] Date of Patent: Jun. 25, 1991

[54] ARAMID PAPERS CONTAINING ARAMID PAPER PULP

[75] Inventors: Lee J. Hesler, Richmond; Stanley C. Park, Midlothian, both of Va.

[73] Assignee: E. I. Du Pont de Nemours and Company, Wilmington, Del.

[21] Appl. No.: 538,281

[22] Filed: Jun. 14, 1990

[51] Int. Cl.[5] ..... D21H 13/26

[52] U.S. Cl. ..... 162/146; 162/157.3; 162/201

[58] Field of Search ..... 162/146, 157.3, 9, 201, 162/100, 147, 149, 4, 13

[56] References Cited

U.S. PATENT DOCUMENTS

| | | | |
|---|---|---|---|
| 2,999,788 | 9/1961 | Morgan | 162/146 |
| 3,756,908 | 9/1973 | Gross | 162/146 |
| 3,920,428 | 11/1975 | Kinsley, Jr. | 55/528 |
| 4,698,267 | 10/1987 | Tokarsky | 162/146 |

FOREIGN PATENT DOCUMENTS 1336691 11/1973 United Kingdom .

*Primary Examiner*—Peter Chin

[57] ABSTRACT

An aramid paper which has high porosity while exhibiting the usual tensile properties is disclosed. The paper has good saturability and a smooth surface while retaining high break strength.

14 Claims, 3 Drawing Sheets

ARAMID PAPERS CONTAINING ARAMID PAPER PULP

BACKGROUND OF THE INVENTION

1. Field of the Invention

This invention relates to an improved aramid paper which has high porosity while maintaining good tensile properties. The invention provides for adjustment of the porosity by compositional changes while yielding a paper with a smooth surface suitable for automatic processing where excessive surface roughness cannot be tolerated. The invention also relates to a process for making the improved high porosity paper.

This invention provides an improved aramid paper having good saturability and a smooth surface while retaining break strength.

2. Description of the Prior Art

U.S. Pat. Nos. 2,999,788 and 3,756,908, issued Sept. 12, 1961 and Sept. 4, 1973, respectively, describe nonwoven sheet structures utilizing aramid fibrids and aramid floc. Those patents describe the preparation of aramid fibrids and the use of such fibrids in making synthetic papers.

U.S. Pat. No. 3,920,428, issued Nov. 18, 1975, discloses preparation of filter media using a mixture of glass fibers and disintegrated synthetic papers of aramid fibrids and aramid floc. Glass fibers are required and only disintegrated paper is used.

British Patent No. 1,336,691, published Nov. 7, 1973, discloses nonwoven sheets utilizing aramid fibrids and floc of aramid or polyester.

SUMMARY OF THE INVENTION

This invention provides a high porosity paper comprising 10–40% by weight of aramid fibrids, 5–30% by weight of high temperature resistant floc, and 30–85% by weight of aramid paper pulp. More specifically, the high porosity paper of this invention comprises previously-dried aramid fibrids and previously-dried aramid floc from aramid paper pulp and, also, fresh aramid fibrids and fresh high temperature resistant floc. The aramid paper pulp comprises 50–60% aramid fibrids and 40–50% aramid floc. The preferred composition for paper of this invention includes 20–35% aramid fibrids, 5–20% floc, and 55–70% aramid paper pulp. The preferred paper of this invention is calendered to a density of 0.6–0.8 g/cc. The preferred paper has a thickness of about 26–769 microns (1 to 30 mils) after calendering.

The paper of this invention with its use of aramid paper pulp, has a porosity greater than the porosity of an aromatic polyamide paper made using the same manufacturing process and conditions and containing the same ratio of fibrids and floc with no aramid pulp. Porosity is determined by a test which measures a time for flow of air through the paper and a calendered paper of this invention exhibits a porosity of less than about 200 seconds for a thickness of about 50 microns.

DETAILED DESCRIPTION OF THE INVENTION

Figure 1:
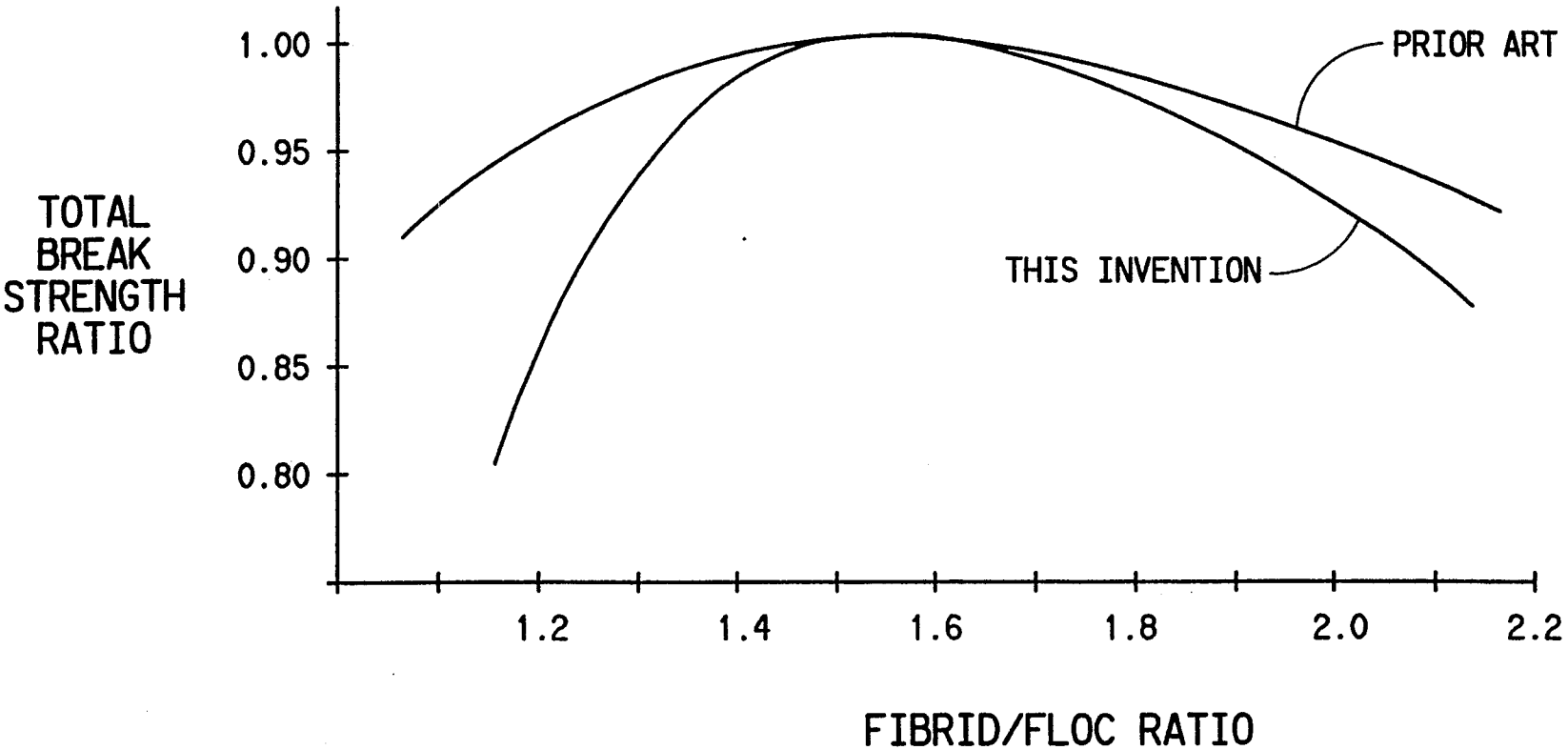
FIG. 1 is a graphical comparison of the break strength of papers of this invention with papers using wholly fresh fibrids and floc, as a function of the total fibrid/floc fatio.

The paper of this invention includes aramid fibrids and, preferably, aramid floc. By "aramid" is meant a polyamide wherein at least 85% of the amide (—CONH—) linkages are attached directly to two aromatic rings. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. In the practice of this invention, the aramids most often used are: poly(paraphenylene terephthalamide) and poly(meta-phenylene isophthalamide).

"Aramid fibrids" refers to non-granular film-like particles of aromatic polyamide having a melting point or decomposition point above 320° C. The fibrids have an average length of 0.2 to 1 mm with a length-to-width aspect ratio of 5:1 to 10:1. The thickness dimension is on the order of a fraction of a micron. Such aramid fibrids, when fresh, are used wet and are deposited as a binder physically entwined about the floc component of the aramid paper. Fresh fibrids and previously-dried fibrids are used in paper of this invention and they can be prepared using a fibridating apparatus of the type disclosed in U.S. Pat. No. 3,018,091 where a polymer solution is precipitated and sheared in a single step. The so-called "fresh fibrids" of this invention are made and used without being dried first. Fresh fibrids are never-dried in that, until being dried as a component of the porous paper of this invention, they have never been dried to the extent that their film-like structure has been collapsed on itself or adhered to adjacent structures.

"High temperature resistant floc" refers to short fibers, typically having a length of 2 to 12 mm and a linear density of 1–10 decitex, made of a material which is non-fusible or which has a melting point higher than 320° C., such as aromatic polyamides, aromatic polyamide-imides, aromatic polyimides, polybenzimidazoles, and the like, or inorganic materials such a glass, ceramic materials, alumina, and the like. Other high temperature resistant materials such as mica may be present in finely divided form. The floc can be fresh or it can be previously-dried. If fresh, it has not before been used in any product; if previously-dried, it has previously been used in an aramid paper product and has been obtained in the form of aramid paper pulp.

"Aramid floc" is high temperature resistant floc referring, specifically, to short fibers cut from longer aramid fibers, such as those prepared by processes described in U.S. Pat. Nos. 3,063,966, 3,133,138, 3,767,756 and 3,869,430.

"Aramid paper pulp" refers to a pulp prepared from dried paper containing floc and fibrids as described in U.S. Pat. Nos. 2,999,788 and 3,756,908 which has been formed on a paper machine. This paper is generally comminuted to pass sorting screens of 6.4–12.7 mm (¼"–½") and, preferably, about 7.9 mm (5/16"); and, then, the comminuted paper can be further milled or ground to reduce the pulp particle size, if desired.

Aramid paper pulp comprises aramid floc and aramid fibrids, generally, in amounts of about 50–60%, by weight, fibrids and 40–50%, by weight, floc. Even after comminution and milling, the floc in aramid paper pulp is bound, to some extent, by the fibrids. The fibrids, being in a dried state, are bound together or collapsed and less useful as binder material than the fresh, never-dried, fibrids; but, due to their random, rigid, irregular, shape, contribute an increased porosity to the final paper structure. For purposes of this invention, those fibrid and floc components taken from dried aramid papers may be called previously-dried fibrids and previously-dried floc.

Dried aramid paper sheets can also be processed through a high speed milling machine, such as a turbulent air grinding mill known as a Turbomill or an Ultra-Rotor, and then wet refined. Turbulent air grinding mills are preferred for comminuting aramid papers which have been calendered; but the grinding mills result in slightly shortened fiber lengths. Paper of this invention using aramid paper pulp with shortened fiber lengths exhibits slightly reduced wet strength and a tendency to worsen paper machine continuity.

The comminuted aramid paper pulp can be refined at a consistency of about 0.4–1.2%, for example, in a 36–2 Sprout-Bauer disc refiner, until the desired particle sizes are obtained. It has been found that a Schopper-Riegler Freeness of about 600–800 ml is satisfactory. Schopper-Riegler Freeness is a measure of drainability and is determined in accordance with International Standard ISO 5267/1-1979 (E) "Pulp-Determination of drainability". Preferred refining consistencies are 0.8–1.0%. A typical size classification by length and freeness values are shown in Table 1.

TABLE 1

| Aramid Paper Pulp Characteristic | |
|---|---|
| Size Range, mm | (% of population) |
| 0.00–0.19 | 25.5 |
| 0.20–0.40 | 35.6 |
| 0.41–0.60 | 17.3 |
| 0.61–0.81 | 9.3 |
| 0.82–1.01 | 5.7 |
| 1.02–1.22 | 3.0 |
| 1.23–1.43 | 1.6 |
| 1.44–1.63 | 0.8 |
| 1.64–4.72 | 1.2 |
| Total | 100.0 |
| *Kajaani Arithmetic Average, mm | 0.35 |
| Schopper Riegler Freeness, ml | 591 |

*Determined using particle size distribution tester identified as Kajaani Model FS-200 sold by Valmet Automation Company, Finland.

The aramid paper pulp, once refined, can be wet screened if such is deemed necessary or desirable, and, then, blended with fresh fibrids and fresh floc and sent to the paper machine headbox.

It is, also possible to combine the comminuted aramid paper pulp with fresh fibrids and refine the mixture. Such a combination of the ingredients before refining, provides the benefit that parallel make-up of a third component stream can be eliminated thereby. This mixture is, then, combined with fresh floc to obtain the paper furnish.

The sheets of this invention are paper-like and are prepared using conventional paper making processes and equipment. Thus the fibrous materials, that is, the fibrids, the floc, and the aramid paper pulp, oan be slurried together to form a furnish which can be converted to paper on, for example, a Fourdrinier paper machine. Of course, production of the papers of this invention is not limited to a Fourdrinier. Papers of this invention can be made on inclined wire or cylinder machines or by other papermaking means, such as by means of a handsheet mold containing a forming screen. A machine such as a Fourdrinier is required to make papers from furnishes having low or slow drainage and was, therefore, necessary for making the control samples for examples described herein. Papers made from furnishes exhibiting low or slow drainage are difficult to make on an inclined wire or cylinder machine. The furnish of this invention using aramid paper pulp is very freely draining and permits high forming rates on a paper machine for a given basis weight.

In determining the amounts of fresh fibrid and fresh floc to be used in papers of this invention, there must be an assessment of the total fibrid and floc from all components. That is, the fibrid and floc content of the aramid paper pulp must be determined and, then, the amounts of fibrid and floc from the aramid paper pulp are added to the amounts of fresh fibrid and fresh floc to determine the total amounts of fibrid and floc in the high porosity paper. For purposes of this invention, "aramid paper pulp" is mentioned to denote the previously-dried fibrids and the previously-dried floc to be added to the aramid paper of the invention from a dried paper source. That fibrid and floc component has been previously dried and, as mentioned elsewhere herein, that previously-dried fibrids and previously-dried floc do not act in exactly the same way that fresh fibrid and fresh floc act.

FIG. 1 is a graphical representation of the break strength ratio as a function of the total fibrid/floc weight ratio for aramid papers. The total break strength ratio is the ratio of the break strength of an aramid paper of this invention compared with the break strength of an aramid paper made in the same way but using only fresh fibrids and floc. The break strength of aramid papers is described in the section titled Test Methods, herein. It should, also, be noted that the total break strength ratio was normalized to be 1.00 at the peak which occurs at a total fibrid/floc ratio of about 1.5.

The fibrid/floc ratio represents the total weight of fibrids divided by the total weight of floc in the aramid paper in question. The dried aramid paper which was used in construction of FIG. 1 was about 55%, by weight, previously-dried fibrids and, in the curve which represents then invention, represented 55–80% of the total material in the paper. It can be seen that a fibrid/floc ratIo of about 1.4 to about 1.8 will permit a total break strength ratio of at least 0.97 for paper of this invention compared with aramid paper made using totally fresh fibrids and floc. On the low fibrid side, it is believed that the break strength decreases as the fibrid content decreases because the paper break strength is reduced by a reduction in binder material. At the other side, the break strength decreases as the floc level is decreased because the paper break strength is a function of floc content. In the optimum range, there is a balance between the fiber strength contributed by floc and the binder strength contributed by fibrids. Although the average floc length of aramid paper pulp is about half of the 6.4 mm (¼") for fresh floc, this reduction in length has little impact on tensile properties in the case of this invention.

It is known that high porosity papers can be made using high levels of floc instead of fibrids. The porosities are increased in such sheets but the strength is reduced compared with that of the present invention. The surface of high floc sheets has loose fiber which is easily abraded and causes problems in handling the material.

Figure 2:
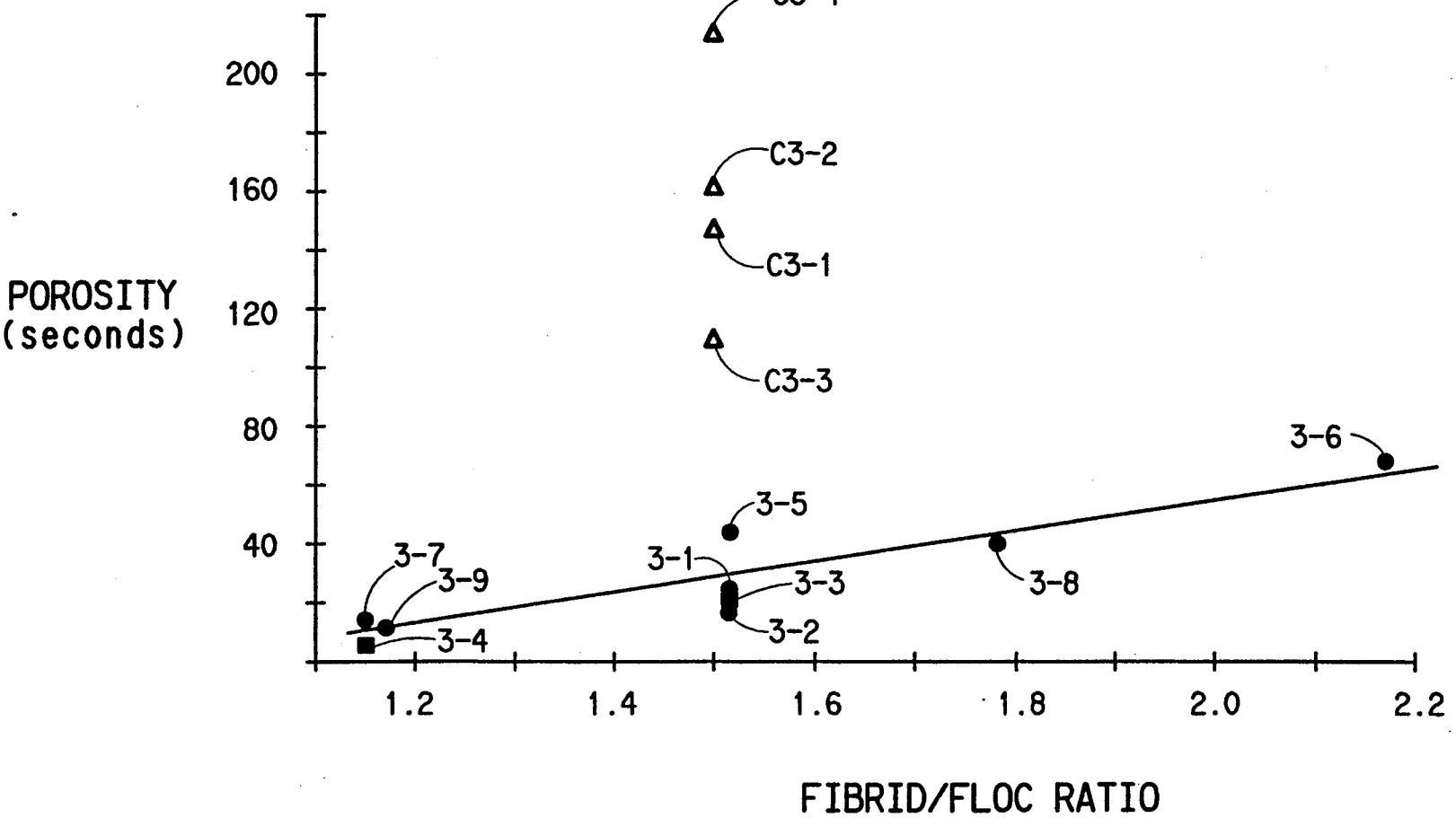
FIG. 2 is a graphical representation of paper porosity as a function of the fibrid/floc ratio.

As the fibrid level of an aramid sheet is increased, the sheet structure tends to be sealed by the fibrids. FIG. 2 shows a relationship between the fibrid/floc ratio and porosity Wherein an increase in fibrid content of a sheet of this invention causes a slight decrease in porosity of the sheet. It can be noted that the porosity of the control sheet, made using only fresh fibrids and floc, is much lower at a fibrid/floc ratio of only 1.5 than the porosity of the sheet of this invention at a fibrid/floc ratio of 2.2—as high as the test was run. The measurements in FIG. 2 are shown for formed paper since the calendered or pressed standard papers have porosities too low to be measured using the specified procedure. Note that the points on the graph of FIG. 2 are identified as the Run Numbers of Example 3, herein, from which they came.

It has been found advisable to limit the amount of aramid paper pulp to less than about 85% and, preferably, less than about 70%, by weight, of the total fibrid and floc content of the paper. Paper making machine continuity is diminished when the pulp is greater than about 85% of the total solids in the furnish; and, at a pulp content greater than about 70%, the uncalendered dry break strength has been found to be below that which is desirable for downstream processing.

Figure 3:
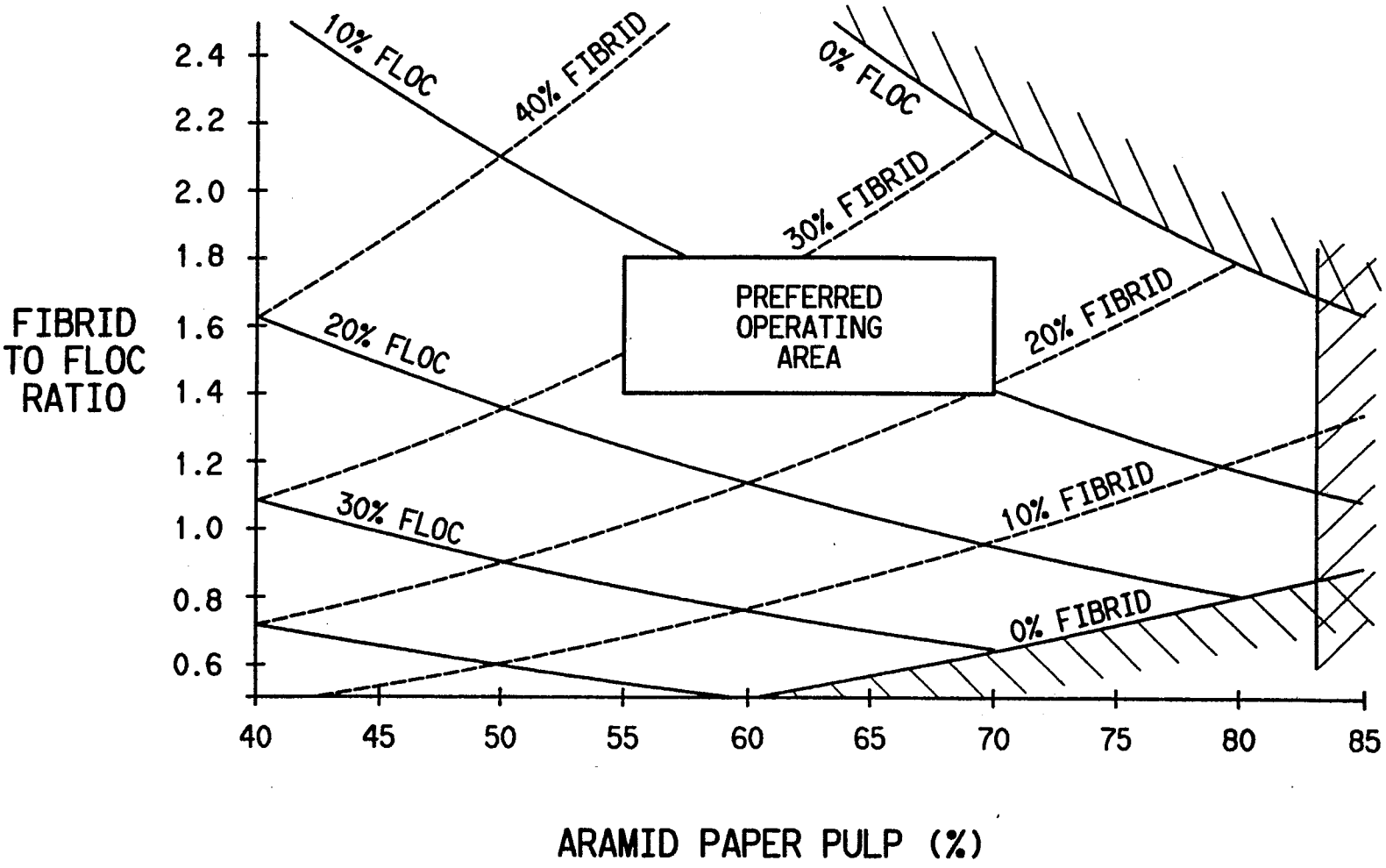
FIG. 3 is a graphical representation of the preferred amounts of fibrid and floc in practice of the present invention.

FIG. 3 shows a field of total fibrid/floc ratio versus per cent aramid paper pulp. A grid of fresh fibrid and fresh floc has been located on the field and the preferred operating area for this invention with regard to fibrid/floc ratio and percent aramid paper pulp has been delineated. The preferred aramid paper pulp level of this invention is 55–70% because the porosity is reduced when less than 55% paper pulp is used; and, as mentioned above, downstream processing is difficult if the paper pulp exceeds 70%. The preferred total fibrid to floc ratio is 1.4–1.8; because, on either side of those limits, the paper break strength is reduced. Paper made with ratios outside this range have less than the desired break strength.

TEST METHODS

Porosity. The porosity of papers is measured using TAPPI test method T 460 om-88 "Air Resistance of Paper". The results of the test are reported in seconds which refers to the number of seconds required for a mass of 567 grams to force 100 ml of air through 6.4 square centimeters (1 square inch) of the paper under test. The greater the test result number in seconds, the lower the porosity of the paper.

Coefficient of static friction. The coefficient of static friction is determined based on TAPPI method T 815 om-85 for "Coefficient of static friction of corrugated and solid fiberboard (inclined plane method)". An inclined plane is raised until sliding of a test sled begins. The coefficient of friction is equal to the tangent of the angle at which sliding begins. The sled is 50.8 mm×101.6 mm (2"×4") with weight of 752.2 grams. A sheet of material 203.2 mm×76.2 mm (8"×3") is attached to the inclined plane in the MD or CD direction and a sheet of material is mounted on the sled in the same direction. The inclined plane is then raised, at a rate of 1–2 degrees per second, until the sled begins to move. The angle is recorded and tangent calculated. The coefficient of static friction is taken as the average of the tangent for ten slides.

Total Break Strength. The tensile break strength of paper is determined based on ASTM method D 828–87 for "Standard Test Method for Tensile Breaking Strength of Paper and Paperboard". Specimens are 2.54 cm wide and 20.3 cm long and the jaws of the tensile testing machine are initially separated by 12.7 cm. Ten paper samples are tested in the machine direction (MD) and ten are tested in the cross direction (CD) and the values for each direction are averaged. The total of the MD and the CD strengths is divided by paper density and paper basis weight to obtain the Total Break Strength.

Thickness. Thickness of papers is determined using calipers in accordance with ASTM D 374–79(1986).

Density. Density of papers is determined by determining the weight per unit area of the paper (Basis Weight) in accordance with ASTM D 646–86 and dividing by the thickness.

EXAMPLE 1

This example illustrates the preparation of papers in accordance with this invention compared with papers containing no aramid paper pulp.

Fibrids of poly(meta-phenylene isophthalamide) were prepared as described in Example 1 of U.S. Pat. No. 3,756,908.

Floc was prepared from poly(meta-phenylene isophthalamide) having an inherent viscosity of about 1.5 by dry spinning from a solution containing 67% DMAc, 9% calcium chloride, and 4% water. The spun filaments were flooded with an aqueous liquid and contained about 100% DMAc, 45% calcium chloride, and 30–100% water based on dry polymer. The filaments were washed and drawn 5× in an extraction-draw process in which the chloride and DMAc contents were reduced to about 0.10% and 0.5%, respectively. The filaments had a denier of 2 and typical properties were: elongation to break, 34%, and tenacity, 4.3 grams/denier. The filaments were then cut to floc length of 0.27 inch (0.68 cm) and slurried in water to a concentration of about 0.35%.

Aramid paper pulp was made from aramid sheets which contained about 55% poly(meta-phenylene isophthalamide) fibrids and 45% poly(meta-phenylene isophthalamide) floc. The sheets were milled in a granulator with a 5/16"screen opening at the exit. The granulated sheet material was pulped in water at 6% consistency and was, then, refined in a Sprout-Bauer 36–2 refiner at 0.8–1.0% consistency to a Schopper-Riegler Freeness of 300 to 400 ml. That slurry was wet screened through screen(s) with 1.40 to 1.57 mm holes and combined, prior to the headbox, with fresh fibrids and fresh floc in solids ratios of 55:30:15 and 70:15:15, as indicated in Table 2, below.

TABLE 2

| Run Number | Ingredients Fibrid % | Ingredients Floc % | Ingredients Pulp % | Total Sheet Fibrid % | Total Sheet Floc % | Fibrid to Floc Ratio |
|---|---|---|---|---|---|---|
| Papers of this Invention | | | | | | |
| 1-1 | 30 | 15 | 55 | 60 | 40 | 1.52 |
| 1-2 | 30 | 15 | 55 | 60 | 40 | 1.52 |
| 1-3 | 15 | 15 | 70 | 54 | 47 | 1.15 |
| 1-4 | 30 | 15 | 55 | 60 | 40 | 1.52 |
| 1-5 | 30 | 15 | 55 | 60 | 40 | 1.52 |
| 1-6 | 30 | 15 | 55 | 60 | 40 | 1.52 |
| 1-7* | 30 | 15 | 55 | 60 | 40 | 1.52 |

TABLE 2-continued

| Run Number | Ingredients Fibrid % | Ingredients Floc % | Ingredients Pulp % | Total Sheet Fibrid % | Total Sheet Floc % | Fibrid to Floc Ratio |
|---|---|---|---|---|---|---|
| | | | Control papers | | | |
| C1-1 | 60 | 40 | 0 | 60 | 40 | 1.50 |
| C1-2 | 54 | 46 | 0 | 54 | 46 | 1.17 |
| C1-3 | 60 | 40 | 0 | 60 | 40 | 1.50 |
| C1-4 | 40 | 60 | 0 | 40 | 60 | 0.67 |
| C1-5 | 30 | 70 | 0 | 30 | 70 | 0.43 |
| C1-6 | 20 | 80 | 0 | 20 | 80 | 0.25 |

*The aramid paper pulp for this run was processed through an Ultra-Rotor prior to refining.

The blend of ingredients was diluted to a consistency of about 0.35% and fed to the headbox of a Fourdrinier paper machine and then to a forming wire for the production of wet sheet. The wet sheet material was removed from the wire and additional water was removed by pressing and through the use of steam heated dryer cans. The dried paper was calendered at 327° C., at 9.15 m/m (30 fpm) and under a nip pressure of 144.5 kN/m (825 PLI). The control papers were made in the same way except that no aramid paper pulp was used in the furnish. The key paper properties are shown below, in Table 3, for the papers of this invention and for the control papers. The papers of this invention evidence a large increase in porosity and a similar break strength, as compared with the control papers. At equivalent paper porosities, the strength of the paper of this invention is much greater than that of the control paper.

TABLE 3

| Run Number | Porosity Seconds formed | Porosity Seconds calend. | Calendered Paper Properties: Basis Weight g/m² | Thickness microns | Density g/cc | Total Break/Den/BW |
|---|---|---|---|---|---|---|
| | | | Papers of this Invention | | | |
| 1-1 | — | — | 40.0 | 67 | 0.60 | 0.158 |
| 1-2 | 7 | — | 40.3 | 72 | 0.56 | 0.189 |
| 1-3 | 7 | — | 40.7 | 74 | 0.56 | 0.177 |
| 1-4 | 42 | — | 40.7 | 70 | 0.58 | 0.181 |
| 1-5 | 7 | 176 | 38.3 | 66 | 0.58 | 0.162 |
| 1-6 | 6 | 196 | 39.7 | 74 | 0.54 | 0.138 |
| 1-7* | 14 | 729 | 38.0 | 58 | 0.64 | 0.171 |
| | | | Control papers | | | |
| C1-1 | 64 | >1800 | 40.5 | 61 | 0.65 | 0.108 |
| C1-2 | — | — | 39.7 | 61 | 0.66 | 0.129 |
| C1-3 | 343 | >1800 | 42.0 | 56 | 0.77 | 0.138 |
| C1-4 | 39 | >1800 | 40.3 | 64 | 0.64 | 0.150 |
| C1-5 | 10 | 355 | 41.7 | 64 | 0.65 | 0.130 |
| C1-6 | 2 | 25 | 40.0 | 74 | 0.55 | 0.123 |

*The aramid paper pulp for this run was processed through an Ultra-Rotor prior to refining.

EXAMPLE 2

This example presents a comparison of the surface characteristics of paper from the prior art with surface characteristics of the paper of this invention. Calendered sheets of this invention have a surface integrity which is much improved over sheets from the prior art made with similar porosity.

Calendered paper samples from the previous example were tested for coefficient of friction and, then, for the degree of roughness after a standardized abrasion procedure.

| Coefficient of Static friction: Sample Number | Coefficient of friction |
|---|---|
| 1-5 | 0.227 |
| C1-3 | 0.196 |
| C1-6 | 0.304 |

The high friction coefficient is typical of high porosity samples not of this invention. Note that C1-6, from Example 1, above, exhibited a porosity of only 25 seconds.

In order to further investigate the abrasion qualities of these papers, the papers on which the coefficient of friction test was conducted were folded along the direction of the sled travel and the edge of the fold was viewed against a dark background. The number of fibers extending greater than about 0.5 mm above the solid paper surface was taken as the Abraded Fiber Count (per centimeter) and indicates the degree of roughness of the sample.

| Abraded Fiber Count: Sample Number | Fiber Count (per cm) |
|---|---|
| 1-5 | 2.8 |
| C1-3 | 0.8 |
| C1-6 | 13.4 |

The higher fiber count above the calendered surface also correlates well with the friction coefficient data.

The sheets in this invention are normally calendered or subjected to high temperatures and pressures which improves their physical properties due to increased bonding strength arising from compaction. An effective calendering process is described in U.S. Pat. No. 4,481,060.

EXAMPLE 3

This example illustrates the preparation of papers in accordance with this invention compared with papers containing no aramid paper pulp. The papers of this example have a higher basis weight than those in Example 1.

Fibrids and floc in this example were the same as those materials used and described in Example 1. The aramid paper pulp was the same as that material used and described in Example 1.

The slurry of aramid paper pulp was wet screened through a screen with 1.14 to 1.57 mm holes and combined, prior to the headbox, with the fibrids and the floc in solids ratios of 55:30:15 and 70:15:15, as indicated in Table 4, below.

TABLE 4

| Run Number | Ingredients Fibrid % | Ingredients Floc % | Ingredients Pulp % | Total Sheet Fibrid % | Total Sheet Floc % | Fibrid to Floc Ratio |
|---|---|---|---|---|---|---|
| | | | Papers of this Invention | | | |
| 3-1 | 30 | 15 | 55 | 60 | 40 | 1.52 |
| 3-2 | 30 | 15 | 55 | 60 | 40 | 1.52 |
| 3-3* | 30 | 15 | 55 | 60 | 40 | 1.52 |
| 3-4* | 15 | 15 | 70 | 54 | 47 | 1.15 |
| 3-5 | 30 | 15 | 55 | 60 | 40 | 1.52 |
| 3-6 | 30 | 0 | 70 | 69 | 32 | 2.17 |
| 3-7 | 15 | 15 | 70 | 54 | 47 | 1.15 |
| 3-8 | 20 | 0 | 80 | 64 | 36 | 1.78 |
| 3-9 | 10 | 10 | 80 | 54 | 46 | 1.17 |

TABLE 4-continued

| Run Number | Ingredients Fibrid % | Ingredients Floc % | Ingredients Pulp % | Total Sheet Fibrid % | Total Sheet Floc % | Fibrid to Floc Ratio |
|---|---|---|---|---|---|---|
| | | | Control papers | | | |
| C3-1 | 60 | 40 | 0 | 60 | 40 | 1.50 |
| C3-2 | 60 | 40 | 0 | 60 | 40 | 1.50 |
| C3-3 | 60 | 40 | 0 | 60 | 40 | 1.50 |
| C3-4 | 60 | 40 | 0 | 60 | 40 | 1.50 |

*The aramid paper pulp for these runs was processed through an Ultra-Rotor prior to refining.

The blend of ingredients was diluted to a consistency of about 0.35% and fed to the headbox of a Fourdrinier paper machine and then to a forming wire for the production of wet sheet. The wet sheet material was removed from the wire and additional water was removed by pressing and through the use of steam heated dryer cans. The dried paper was calendered at 327° C., at 9.15 m/m (30 fpm) and under a nip pressure of 144.5 kN/m (825 PLI). The control papers were made in the same way except that no aramid paper pulp was used in the furnish. The key paper properties are shown below, in Table 5, for the papers of this invention and for the control papers. The papers of this invention evidence a large increase in porosity, as compared with the control papers.

TABLE 5

| Run Number | Porosity Seconds formed | Porosity Seconds calend. | Calendered Paper Properties: Basis Weight g/m² | Thickness microns | Density g/cc | Total Break/Den/BW |
|---|---|---|---|---|---|---|
| | | | Papers of this Invention | | | |
| 3-1 | 23 | — | 57.3 | 81 | 0.71 | 0.158 |
| 3-2 | 15 | >1800 | 60.4 | 84 | 0.71 | 0.087 |
| 3-3* | 20 | >1800 | 56.2 | 79 | 0.72 | 0.082 |
| 3-4* | 6 | >1800 | 58.0 | 86 | 0.66 | 0.086 |
| 3-5 | 42 | — | 67.8 | 86 | 0.78 | 0.103 |
| 3-6 | 66 | — | 69.5 | 86 | 0.81 | 0.089 |
| 3-7 | 15 | — | 66.8 | 86 | 0.78 | 0.082 |
| 3-8 | 38 | — | 67.8 | 91 | 0.74 | 0.100 |
| 3-9 | 12 | — | 64.4 | 94 | 0.68 | 0.087 |
| | | | Control papers | | | |
| C3-1 | 145 | >1800 | 62.1 | 81 | 0.75 | 0.101 |
| C3-2 | 159 | >1800 | 67.8 | 86 | 0.78 | 0.102 |
| C3-3 | 109 | >1800 | 61.4 | 81 | 0.76 | 0.108 |
| C3-4 | 213 | — | 62.4 | 81 | 0.77 | 0.136 |

*The aramid paper pulp for this run was processed through an Ultra-Rotor prior to refining.

What is claimed is:

1. A high porosity paper containing 30–85% of aramid paper pulp prepared by comminuting dry aramid paper containing 50 to 60% aramid fibrids and 40 to 50% aramid floc to a particle size capable of passing through a sorting screen of 6.4–12.7 mm, the remainder of the sheet comprising fibrids and high temperature resistant floc.

2. The paper of claim 1 wherein the fibrids are aramid fibrids.

3. The paper of claim 1 wherein the floc is aramid floc.

4. The paper of claim 1 wherein the porosity is greater than the porosity of an aromatic polyamide paper made using the same manufacturing process and conditions and containing the same ratio of fibrids and floc with no aramid paper pulp.

5. The paper of claim 1 exhibiting a porosity of less than 200 seconds at a thickness of 50 microns.

6. A high porosity paper comprising 10–40% by weight of aramid fibrids, 5–30% by weight of high temperature resistant floc, and 30–85% by weight of aramid paper pulp prepared by comminuting dry aramid paper containing 50 to 60% aramid fibrids and 40 to 50% aramid floc to a particle size capable of passing through a sorting screen of 6.4–12.7 mm.

7. The paper of claim 6 wherein the floc is aramid floc.

8. The paper of claim 6 wherein the porosity is greater than the porosity of an aromatic polyamide paper made using the same manufacturing process and conditions and containing the same ration of fibrids and floc with no aramid paper pulp.

9. The paper of claim 6 exhibiting a porosity of less than 200 seconds at a thickness of 50 microns.

10. A high porosity aramid paper comprising 30–85% by weight aramid paper pulp prepared by comminuting dry aramid paper containing 50 to 60% aramid fibrids and 40 to 50% aramid floc to a particle size capable of passing through a sorting screen of 6.4–12.7 mm, the remainder of the sheet comprising fibrids and floc, the high porosity aramid paper comprising a total fibrid/floc weight ratio of 1.4 to 1.8.

11. The paper of claim 10 wherein the porosity is greater than the porosity of an aromatic polyamide paper made using the same manufacturing process and conditions and containing the same ratio of fibrids and floc with no aramid paper pulp.

12. The paper of claim 11 exhibiting a porosity of less than 200 seconds at a thickness of 50 microns.

13. A process for making a high porosity paper comprising the steps of a) comminuting dried aramid paper pulp containing 50 to 60% fibrids and 40 to 50% floc to a particle size capable of passing through a sorting screen of 6.4 to 12.7 mm;

b) combining the comminuted dried aramid paper with aramid fibrids and high temperature resistant floc such that the combination includes 10–40% by weight of aramid fibrids, 5–30% by weight of high temperature resistant floc, and 30–85% by weight of aramid paper pulp; and c) making paper from the combination of b).

14. The process of claim 13 wherein the high temperature resistant floc is aramid floc.

* * * * *